US006203594B1

(12) United States Patent
Hille

(10) Patent No.: US 6,203,594 B1
(45) Date of Patent: Mar. 20, 2001

(54) METHOD FOR REDUCING IRON ORE IN A BLAST FURNACE

(75) Inventor: Hartmut Hille, Moers (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/227,168

(22) Filed: Jan. 7, 1999

(30) Foreign Application Priority Data

Jan. 23, 1998 (DE) ..... 198 02 338

(51) Int. Cl.[7] ..... C21B 5/06

(52) U.S. Cl. ..... 75/463; 75/468; 75/471; 266/156

(58) Field of Search ..... 75/463, 468, 471; 266/160, 156

(56) References Cited

U.S. PATENT DOCUMENTS 3,909,446 * 9/1975 Miyashita et al. ..... 75/463
4,316,741 * 2/1982 Wetzel ..... 75/463

FOREIGN PATENT DOCUMENTS

2916908 U 11/1980 (DE) .

OTHER PUBLICATIONS

"Stand Der Kohleeinblastechnik In Den Hochofen Bei Den Mitgliedswerken Des VDEh", Stahl Und Eisen 108 (1988), No. 9, pp. 459—467.

* cited by examiner

*Primary Examiner*—Melvyn Andrews
(74) *Attorney, Agent, or Firm*—Friedrich Kueffner

(57) ABSTRACT

A method and a plant for reducing iron ore to pig iron in a blast furnace with the use of carbon, wherein a partial quantity of the carbon is admixed to the iron ore in the form of coke which ensures that the bulk material column is loosened and supported and that the gas can penetrate through the bulk material column in the blast furnace, and wherein the remaining partial carbon quantity is injected as a substitute reducing agent into the blast furnace. Prior to being injected into the blast furnace, the entire partial carbon quantity forming the substitute reducing agent is converted into a low-nitrogen reducing gas by gasification in a gasification reactor arranged spatially separate from the blast furnace.

4 Claims, 1 Drawing Sheet

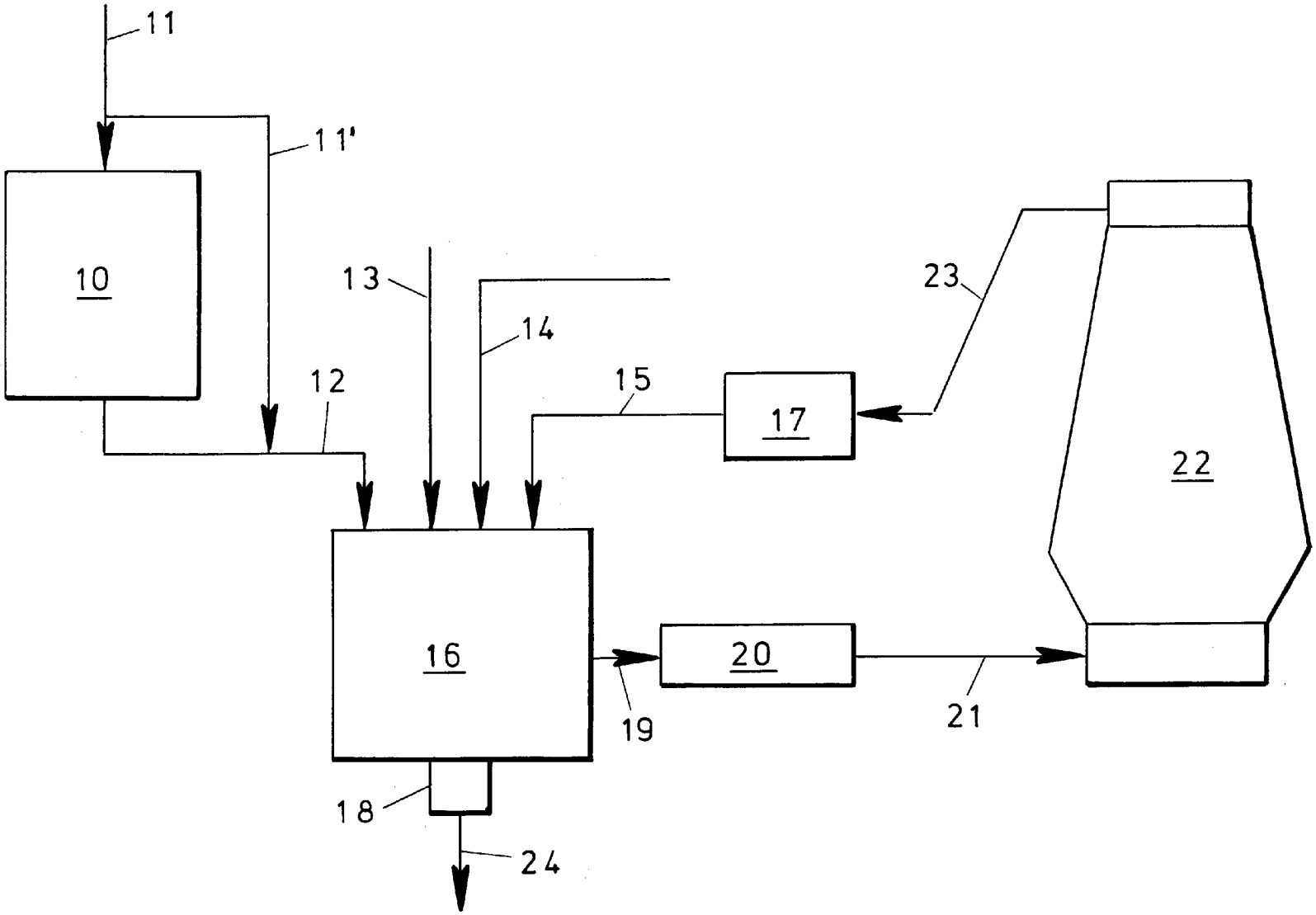
22
23
17
15
14
13
11'
11
10
12
16
18
24
19
20
21

METHOD FOR REDUCING IRON ORE IN A BLAST FURNACE

BACKGROUND OF THE INVENTION

1. Field of the Invention

The present invention relates to a method and a plant for reducing iron ore to pig iron in a blast furnace by means of carbon, wherein a partial quantity of the carbon is admixed to the iron ore in the form of coke which ensures that the bulk material column is loosened and supported and that the gas can penetrate through the bulk material column in the blast furnace, and wherein the remaining partial carbon quantity is injected as a substitute reducing agent into the blast furnace.

2. Description of the Related Art

The injection of carbon carrier, such as, for example, natural gas, heavy oil, fine coal, into the blast furnace as a substitute reducing agent for saving coke has already been practiced for many years.

The simplest and most reliable manner of introducing the substitute reducing agent into the blast furnace is to add it through the blast tuyeres of the blast furnace. In the immediate tuyeres area, the substitute reducing agents are initially combusted with hot air to $CO_2$ and $H_2O$ and then reduced to CO and $H_2$ when impinging upon the coke.

When introducing the substitute reducing agents into the blast furnace, it is desired that a complete combustion or gasification of the substitute reducing agents takes place in the oxidizing tuyeres area of the hearth zone, while simultaneously the blast tuyeres and blast pipes are to be protected as much as possible against destruction due to an early combustion of the substitute reducing agents.

This object is easiest to meet in case of gaseous substitute reducing agents and is most difficult in case of solid substitute reducing agents, such as, for example, fine coal. Therefore, for injecting fine coal as the substitute reducing agent, various coal dust injection systems and blasting methods have been developed over time as described in the publication "Stand der Kohleeinblastechnik in den Hochofen bei den Mitgliedswerken des VDEh" [State of the carbon injection technology in the blast furnaces of member plants of VDEh], Stahl und Eisen 108 (1988), No. 9, pages 459–467. The primary focus and object of the developments was to lower the energy costs and to reduce the coke consumption in the blast furnace by using substitute reducing agents. However, in accordance with experience with actual operations, injection quantities of above 200 kg coal/t pig iron were difficult to achieve permanently for reasons of process technology.

SUMMARY OF THE INVENTION

Therefore, in view of the technologies which are known in the art and are used frequently, it is the object of the present invention to further increase the quantity of substitute reducing agents used in order to lower the energy costs and, in particular, to develop a method which makes it possible to utilize additional materials as substitute reducing agents which are difficult to treat.

In accordance with the present invention, prior to being injected into the blast furnace, the entire partial carbon quantity forming the substitute reducing agent is converted into a low-nitrogen reducing gas by gasification in a gasification reactor arranged spatially separate from the blast furnace.

As a result of the measure according to the present invention of reducing the reducing gas to be formed from the substitute reducing agents outside of the blast tuyeres of the blast furnace in a separate gasification reactor, it is possible to manufacture a low-nitrogen reducing gas which is injected at as high a temperature as possible as a reducing gas through the blast tuyeres into the blast furnace. Therefore, the temperature of the reducing gas is adjusted in such a way that it can be transported in pipelines with or without refractory linings to the blast tuyeres. A complicated gas purification and desulfurization of the produced reducing gases is not required because in the directly injected substitute reducing agents such afterpurifications are also not carried out, and the dust transported by the reducing gas burns off harmlessly in front of the blast tuyeres.

However, if the substitute reducing agents used require it because of their chemical composition, for example, in the case of waste materials, it is also possible to carry out such an afterpurification of the hot gases, so that the blast furnace is not burdened unnecessarily by impurities.

The energy required for the external gasification of the substitute reducing agents can be supplied by the combustion of blast furnace gas and/or by a supplied fuel and/or by the uncoupling of heat from the hot air production which is overdimensioned after an existing blast furnace plant has been converted to produce the reducing gases outside of the blast furnace.

The injection of the reducing gas makes it no longer necessary to enrich the hot air with oxygen which when injecting solid substitute reducing agents serves for the gasification of the substitute reducing agent and for adjusting the flame temperature in front of the blast tuyeres. This oxygen which is no longer required can now be used for the gasification reactions.

The measure according to the present invention substantially reduces the quantity of air required. For example, in the case of the conventional carbon injection rates of about 100 kg/t pig iron, approximately 350 $Nm^3$/t pig iron air is required with a nitrogen quantity of about 240 $Nm^3$/t pig iron. When producing the reducing gas in an external gasification reactor, this quantity of nitrogen is entirely or partially omitted, i.e., the reducing gas quantity can be increased by this quantity in the blast furnace without disadvantageously increasing the flow velocities of the reducing gas in the blast furnace. Consequently, a significant increase of the output of the blast furnace is possible; in addition, the calorific value of the blast furnace gas is also increased because it does not contain nitrogen.

Moreover, it is no longer necessary to smelt the ash of the injected substitute reducing agents in the bottom furnace of the blast furnace because this ash remains in the solid or liquid form in the gasification reactor. In addition to reducing the thermal energy to be used for this purpose, the additives in the charge which are otherwise required for smelting are reduced or not required.

Also, the better and easier distribution of the reducing gas over the individual blast tuyeres, which according to the invention can be carried out without requiring complicated apparatus, utilizes advantageous devices as compared to the known methods in which the substitute reducing agents are pneumatically conveyed and directly injected.

Finally, the separate control of the gasification process outside of the blast furnace is a decisive advantage because this gasification process can be adapted individually to the materials to be gasified by using an appropriate measuring and regulating technology, so that it is also possible to use difficult waste materials as substitute reducing agents for the gasification; this would not be possible in the case of gasification in the blast furnace.

A plant in which the method according to the present invention can be carried out can be installed without significant difficulties in already existing blast furnace plants. The plant according to the present invention includes a gasification reactor which is connected through pipelines to the blast furnace in such a way that the reducing gases produced in the gasification reactor can be introduced into the individual blast tuyeres. The temperature of the reducing gas is adjusted in such a way that an advantageous transport and distribution of the gas takes place.

If required, arranged upstream of the gasification reactor is a processing plant for processing the substitute reducing agents until they have the properties required for their gasification, such as, grain size, degree of dryness and carbon content.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a schematic illustration of a plant for producing reducing gases from a substitute reducing agent.

DESCRIPTION OF THE PREFERRED EMBODIMENTS

The substitute reducing agent 11 from a carbon carrier is initially supplied to a processing plant 10 in which it is comminuted and dried as required and, for example, in the case of waste materials, the concentration of the carbon content is decreased to a value required for the gasification.

The substitute reducing agent processed in this manner is conveyed by a suitable conveying unit 12 to the gasification reactor 16, for example, a fluidized bed reactor. If processing of the substitute reducing agent 11 is not required, it is conveyed by a suitable conveying unit 11' past the processing plant 10 and fed into the conveying unit 12.

The gasification of the substitute reducing agent 11 into a reducing gas 19 suitable for the blast furnace 22 takes place in the gasification reactor 16, wherein, if required, the gas can be cooled in a cooling unit 20 arranged following the gasification reactor 16 and is then conveyed through the pipeline 21 to the blast furnace 22 or to the blast tuyeres thereof.

The gasification residues 24 produced during the gasification leave the gasification reactor 16 through a discharge unit 18.

If required, it is possible to arrange in front of or following the cooling unit 20 a gas purifying plant, not shown, for purifying the reducing gases from components which are harmful to the blast furnace operation.

Heating of the gasification reactor 16 is effected a) by means of a supplied fuel 13 or a mixture of various fuels in a combustion chamber of the gasification reactor 16 and/or b) by heat 14 uncoupled from the hot air production and/or c) by blast furnace gas 23 which is combusted in a combustion unit 17 and is obtained as combustion heat 15.

By using appropriate measuring and regulating devices, not shown, the gasification in the gasification reactor 16 can be adapted individually to the material being charged, so that in cooperation with the processing plant and possibly with a gas purifying plant, it is possible to produce a useful reducing gas 19 from materials which are difficult to process, for example, waste material mixtures (plastic garbage, dried sewage sludges, etc.). In this connection, it is also possible to gasify simultaneously several different materials if the existing measuring and regulating technology is appropriately configured for this purpose.

The embodiment of the present invention illustrated in the drawing can be used without problems in new plants or can be integrated in an already existing blast furnace plant, wherein, depending on the properties of the charge materials to be gasified, additional plant components, such as cooling unit, blast furnace gas combustion unit, processing unit, may be omitted.

While specific embodiments of the invention have been shown and described in detail to illustrate the inventive principles, it will be understood that the invention may be embodied otherwise without departing from such principles.

I claim:

1. A method of reducing iron ore in a blast furnace into pig iron with the use of carbon and carrying out a hot air production, the method comprising admixing a first partial quantity of the carbon to the iron ore in the blast furnace in the form of coke for ensuring that a charge material column in the blast furnace is loosened and supported and gas can penetrate through the charge material column, gasifying a remaining second partial carbon quantity constituting a substitute reducing agent outside of the blast furnace in a gasification reactor arranged spatially separate from the blast furnace for producing a gasification product and reduction gas and conducting the gasification product into the blast furnace, and a) removing thermal energy required for the gasification in the gasification reactor from the blast furnace as blast furnace gas subjected to combustion in the gas reactor or as heat removed from the hot air production;

b) carrying out the gasification for producing a low-nitrogen reduction gas by adding oxygen;

c) conducting the reduction gas produced by the gasification in the gasification reactor without admixing additional gases at a high temperature directly to the furnace.

2. The method according to claim 1, comprising using fine coal as the substitute reducing agent.

3. The method according to claim 1, comprising using carbon-containing waste products as the substitute reducing agent.

4. The method according to claim 3, wherein the waste products are sewage sludge, plastic wastes, car tires.

* * * * *